US005239760A

United States Patent [19]

Dixon et al.

[11] Patent Number: 5,239,760

[45] Date of Patent: Aug. 31, 1993

[54] ARCHERY SIGHT

[75] Inventors: Darrell Dixon; Tim Gungoll, both of Rolla, Mo.

[73] Assignee: Dixon Archery, Inc., Rolla, Mo.

[21] Appl. No.: 922,377

[22] Filed: Jul. 30, 1992

[51] Int. Cl.[5] ..... F41G 1/467

[52] U.S. Cl. ..... 33/267; 33/265; 124/87

[58] Field of Search ..... 33/267, 263, 265; 124/87, 88, 86

[56] References Cited

U.S. PATENT DOCUMENTS

| | | | |
|---|---|---|---|
| 2,332,080 | 10/1943 | Howe . | |
| 2,767,472 | 10/1956 | Kocur . | |
| 2,991,556 | 7/1961 | Wilchek . | |
| 3,163,938 | 1/1965 | Reynolds . | |
| 4,400,887 | 8/1983 | Mason | 33/265 |
| 4,417,403 | 11/1983 | Strange | 33/265 |
| 4,462,163 | 7/1984 | Tentler et al. | 33/265 |
| 4,625,420 | 12/1986 | Figured . | |
| 4,625,421 | 12/1986 | Strauss . | |
| 4,643,160 | 2/1987 | Gray et al. | 33/265 |
| 4,715,126 | 12/1987 | Holt . | |
| 4,794,702 | 1/1989 | Martin | 33/265 |
| 4,974,328 | 12/1990 | Lowry | 33/265 |
| 4,984,372 | 1/1991 | Blizzard . | |
| 5,050,576 | 9/1991 | Larson | 33/265 |
| 5,072,716 | 12/1991 | Sappington | 33/265 |
| 5,131,153 | 7/1992 | Seales | 33/265 |

*Primary Examiner*—William A. Cuchlinski, Jr.
*Assistant Examiner*—C. W. Fulton
*Attorney, Agent, or Firm*—Kokjer, Kircher, Bowman and Johnson

[57] ABSTRACT

An archery sight for bows having a mounting bracket to be affixed a riser of a bow. The mounting bracket supports an adjustment bracket, which in turns supports the sight mechanism. The adjustment bracket provides for gross adjustment of the sight mechanism vertically and laterally with respect to the riser. The sight mechanism includes a slide plate extending forward of the riser and mounting a pin carriage which may slide forward an rearward along the slide plate. The pin carriage mounts a plurality of pins or indicators which extend laterally and include free ends which act as sight locations in use. The pins may individually slide vertically within the pin carriage, and extend through respective slots in the slide plate. The slots have increasing, yet proportionally constant spacing therebetween such that movement of the carriage with respect to the plate will cause the pins to move along the various slots to expand or contract their relative positioning. In use, the user will mount the sight to the riser of the bow and preform gross adjustments until a first one of the pins is properly positioned to correspond to a particular predetermined distance. The user will then move the pin carriage forward or rearward along the slide place until a second of the pins is properly positioned for a second predetermined distance. At this point the remainder of the pins, due to the fixed proportional spacing, will be in the proper position for the remaining predetermined distances.

8 Claims, 2 Drawing Sheets

ARCHERY SIGHT

BACKGROUND OF THE INVENTION

1. Field of the Invention

The present invention relates in general to archery and bow hunting equipment. In particular, the present invention relates to an improved sight for use upon an archery bow.

2. Description of the Related Art

It has long been known to provide archery bows with sights to improve the accuracy of the arrow shot from the bow. Such sights are typically mounted upon the riser of the bow, above the handle and resting location of the arrow. While various sight arrangements are known, it is common to provide a plurality of pins which extend laterally from the riser to a position above the arrow.

An example of such an archery sight is shown in U.S. Pat. No. 4,715,126 to Holt. With this type of sight the pins are vertically spaced with each pin acting as a sight for a particular yardage. Specifically, the flight of the arrow is substantially ballistic, such that the angle of launch will determine the distance the arrow travels. In use, the archers will gauge the distance to the target and align the head of the appropriate pin upon the desired location for the arrow. As such, the uppermost pin (corresponding to a low launch angle) is typically arranged to correspond to a twenty yard flight, the lowest pin (corresponding to a high launch angle) to a sixty yard flight and the intermediate pins to intervals of ten yards therebetween.

While this arrangement is serviceable in operation, it is a time consuming task to calibrate or arrange the pins in the proper location. Not only must each pin be located laterally, but the vertical position of each pin must also be adjusted. This is effected by a trial and error approach. Specifically, the archer will align the particular pin with the target, which is a known distance away, and launch the arrow. If the arrow does not land at the desired position, the archer will then physically move the pin vertically either up or down and launch another arrow. This process is repeated until the pin is properly located, at which point the user moves to another known distance to adjust the placement of a second one of the pins. This is repeated for each of the pins in the sight. As can be readily envisioned, this is an extremely time consuming process.

SUMMARY OF THE INVENTION

An object of the present invention is to provide an archery sight for bows.

Another object of the present invention is to provide such a sight having a plurality of pins acting as individual sights, each corresponding to a particular distance.

Another object of the present invention is t provide such a sight in which the multiple indicators may be easily and quickly placed in their calibrated locations for a particular bow or user.

Another object of the present invention is to provide such a sight in which the plurality of pins may be readily adjusted, yet the relative spacing between the individual indicators remain substantially constant.

These and other objects are achieved by an archery sight for bows having a mounting bracket to be affixed to a riser of a bow. The mounting bracket supports an adjustment bracket, which in turns supports the sight mechanism. The adjustment bracket provides for gross adjustment of the sight mechanism vertically and laterally with respect to the riser. The sight mechanism includes a slide plate extending forward of the riser and mounting a pin carriage which may slide forward and rearward along the slide plate. The pin carriage mounts a plurality of pins or indicators which extend laterally and include free ends which act as sight locations in use. The pins may individually slide vertically within the pin carriage, and extend through respective slots in the slide plate. The slots have increasing, yet proportionally constant spacing therebetween such that movement of the carriage with respect to the plate will cause the pins to move along the various slots to expand or contract their relative positioning. In use, the user will mount the sight to the riser of the bow and preform gross adjustments until a first one of the pins is properly positioned to correspond to a particular predetermined distance. The user will then move the pin carriage forward or rearward along the slide place until a second of the pins is properly positioned for a second predetermined distance. At this point the remainder of the pins, due to the fixed proportional spacing, will be in the proper position for the remaining predetermined distances.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
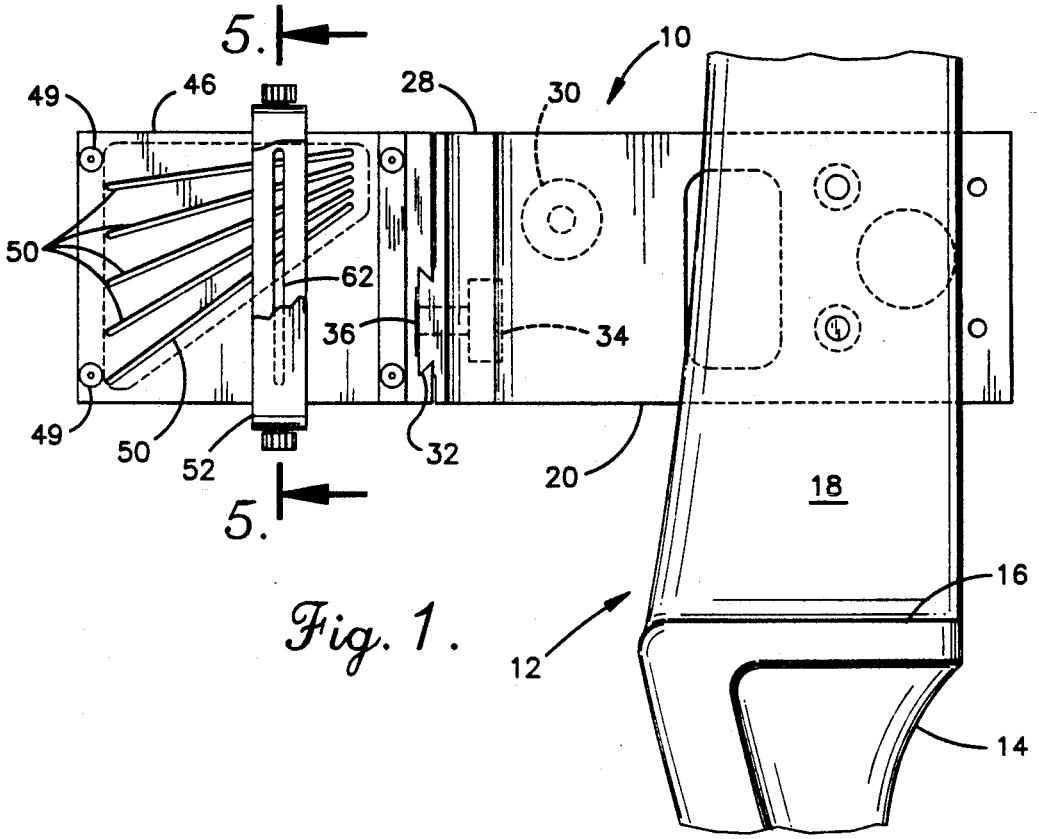
FIG. 1 is a left side view of the device according to the present invention mounted upon a bow.

With reference to the drawings, and in particular FIG. 1, a sight according to the present invention is generally designated by reference numeral 10. The sight 10 is mounted upon a archery bow, generally designated by reference numeral 12. The bow 12 may be of any standard design, and will typically include a handle portion 14 to be grasped by the user and which forms at its upper end a ledge 16 which may be used to support the arrow. Extending upwardly from the ledge 16, and adjacent one lateral side, is a riser 18. It is to this riser that the sight 10 is mounted.

In particular, a substantially planar mounting plate 20 may be fixed to the riser by the use of one or more screws 22 which engage with the riser 18. The mounting plate 20, adjacent its forward (furthest from the archer) end includes a vertically extending dovetail groove 24. This dovetail groove receives a first trapezoidal projection 26 of an adjustment plate 28. The adjustment plate 28 includes a threaded hole (not shown) which extends therethrough at the location of the projection 26 and receives a first adjustment bolt 30. As may be readily seen, the adjustment bolt may be employed to fix the relative positions of the mounting plate and adjustment plate, by moving the adjustment bolt inward such that it abuts against the groove 24 of the mounting plate 20. This will serve to fix the vertical adjustment of the adjustment plate with respect to the mounting plate.

Figure 4:
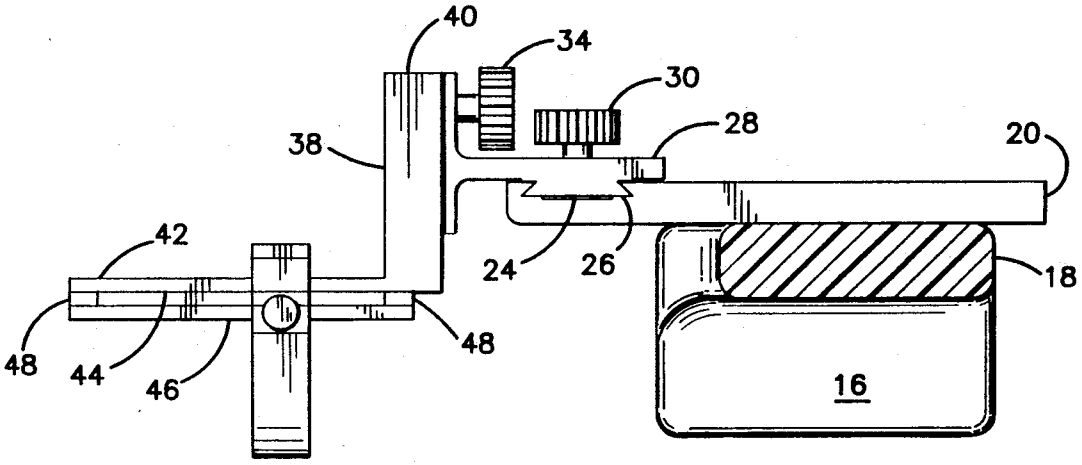
FIG. 4 is a top view of the view of the device.

The forward end of the adjustment plate 28 includes a horizontally laterally extending second trapezoidal projection 32. In a manner similar to the first projection, a threaded hole extends through this second projection and a second adjustment bolt 34 extends through the second projection 32. This second projection is received within a second dovetail groove 36 of a sight assembly 38. As is best shown in FIG. 4, the sight assembly may have a generally L-shaped configuration in a horizontal plane such that a mounting leg 40 containing the laterally extending tongue and groove combination may have a horizontal extent sufficient to provide the desired lateral adjustment of the remaining portion of assembly 38.

The remaining portion, or other leg, of sight assembly 38 includes a substantially planer slide member 42 extending forward of the second groove 36 and, in the embodiment shown in the drawings, forward of the laterally interior end of mounting leg 40. Slide member 42 is oriented to be in a substantially vertical plane, and is formed by first and second slide plates 44 and 46 which are maintained in a spaced opposed relationship by the use of spacers 48 located adjacent the forward and rearward ends of the slide plates. Appropriate screws or bolts 49 (FIG. 1) may extend through the slide plates and spacers to fix these elements in position. The spacers 48 are located such that the space between the slide plates 44 and 46 is accessible from above and below. As will be described in more detail below, each of the slide plates 44 and 46 include a plurality of guide slots 50 which are generally spaced vertically and essentially extend between the spacers 48.

Mounted upon the slide member 42 for sliding movement therealong is a pin carriage 52. The pin carriage 52 includes first and second guide plates 54 and 56 which are elongated in the vertical direction. The guide plates each include an inwardly directed recess sized and shaped to closely conform to the exterior, top and bottom faces of the respective one the slide plates, such that each of the guide plates may have a close sliding fit upon the respective slide plate. Optionally, the pin carriage 52 may include an interior guide 58 which extends between the first and second slide plate 44 and 46 with a close sliding fit. Each of the elements 54, 56 and possibly 58 are fixed in relative position by bolts 60 such that these elements may travel together as a single unit forward and rearward (in the longitudinal direction) along slide member 42.

The first and second guide plate 54 and 56, and the interior guide 58 when employed, will each include a substantially vertical pin groove 62, with each of the grooves 62 being aligned in the lateral direction. The pin grooves 62 in combination with the slots 50 form apertures 64 (FIG. 1) at the respective points of intersection, with these apertures extending through the first guide plate 54, first slide plate 44, interior guide 58 where employed, second slide plate 46 and second guide plate 56.

Extending through each of these apertures 64 is a sight pin 66. The sight pins are preferably circular in cross section and have a diameter that closely corresponds with the width of the grooves 50 and pin grooves 62, such that the sight pins have a close sliding relationship within the apertures formed at the intersections. The pins 66 each include an enlarged head 68 at a laterally exterior end, with this enlarged head prohibiting movement of the sight pin laterally inward through the grooves 50 or 62. The pins are elongated and extend laterally inward to free ends 70 which may be slightly enlarged at the endmost portion, painted various colors, or otherwise formed to standout from the remainder of the pin. These free ends 70 will act as the actual sights to be superimposed over the target.

To ensure that the pins do not move laterally outward from the apertures, a cavity 72 may be formed on the laterally exterior face of the first guide plate 54, with this cavity having a depth substantially corresponding to the length of heads 68. A cover plate 74 may then be fixed over the cavity 72, as by using the bolts 60, to maintain the heads 68 of the pins within this cavity. In a preferred embodiment, the heads 68 may have substantially flat lateral end faces in close sliding relationship with the first guide plate 54 and cover plate 74. This will aide in maintaining the rigid yet sliding mounting of the pins, and reduce the movement experienced at the free ends 70 of the pins.

In particular, the retention of the heads 68 within the cavity 72 ensures that the pins 66 will have very little lateral movement, such that the location of the free ends 70 is predetermined. As such, the pins 66 may be manufactured with very small tolerances upon their length such that the free ends of the pins 66 are very accurately aligned vertically. While this arrangement is preferred, it is also possible to form the pins for lateral adjustment.

For example, the heads 68 could be formed as separate elements with the pins 66 being threaded through the heads 68. An appropriate slot could be formed within the cover plate 74 such that the laterally outward threaded ends of the pins could extend outwardly from the heads, and an appropriate lock nut or other element applied to this laterally outward end to fix the lateral adjustment of the pin.

In either event it is preferred to provide the pin carriage 52 with a pin guard 78 in the form of a U-shaped member which extends about the laterally inward end of the pins 66 to protect the pins from being bent or misshapen by impact with another object. Advantageously, element 78 may be fixed to the pin carriage by the bolts 60.

Figure 5:
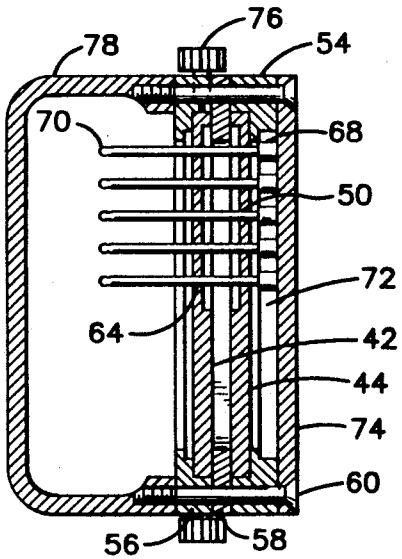
FIG. 5 is a cross sectional view along line 5—5 of FIG. 1.

As may be envisioned by comparison of FIGS. 1 and 5, when the pin carriage 52 is moved forward or rearward along the slide member 42 the pin grooves 62 will engage against the sight pins 66 to force the sight pins to move with the pin carriage along the grooves 50 in the slide member. In a similar manner, the vertical component of the path of grooves 50 will force the pins vertically upward or downward within the pin grooves 62. In this manner the vertical locations of the sight pins may be varied with respect to the riser 18.

Figure 2:
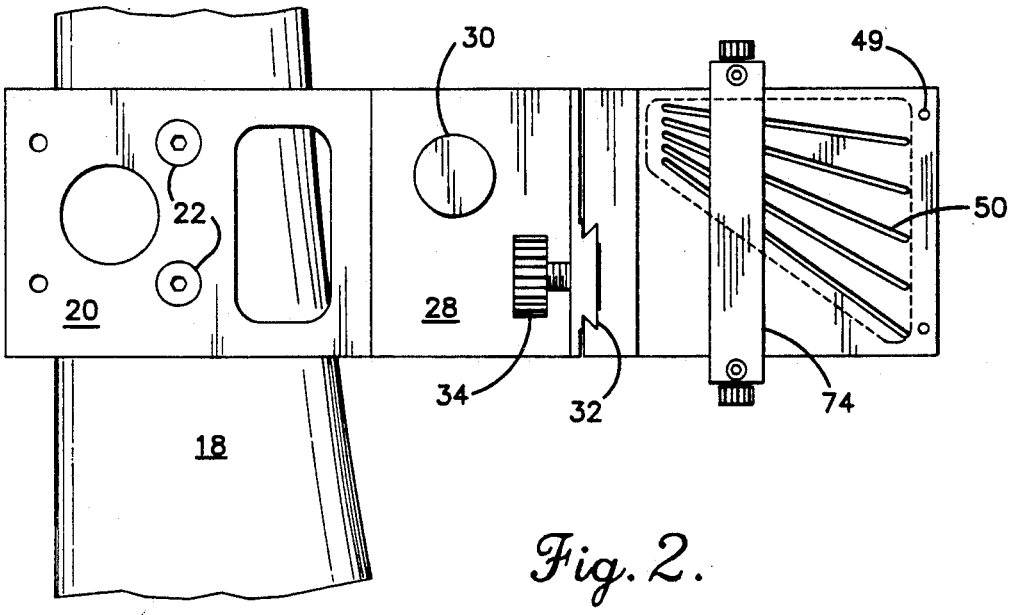
FIG. 2 is a right side view of the device.
Figure 3:
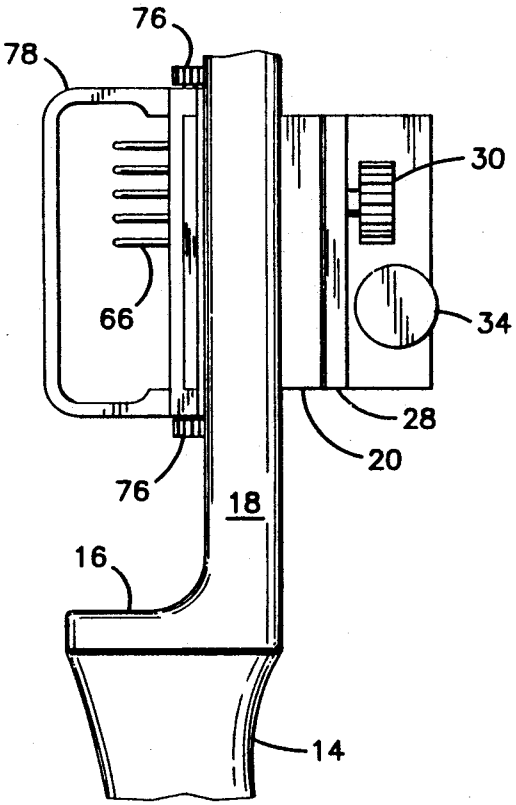
FIG. 3 is a rear or users perspective view of the device.

The location of the pin carriage 52 on the slide member 42 may be releasable fixed by the provision of a carriage lock screw 76 which threaded through the upper end of one element of the pin carriage such that tightening the screw will cause its abutment with an element of the slide member 42, and thus fix the slide member and pin carriage together. A single carriage lock screw 76 may be provided, as shown in FIG. 5, or two lock screws may be provided, one at the upper end and one at the lower end of the pin carriage, as shown in FIG. 1–3.

As is known in the art, the sight pins 66 of the present sight are arranged such that the free ends 70 are in a vertical spaced configuration with each of the pins corresponding to a particular distance between the archer and the target. For instance, alignment of the free end 70 of the uppermost pin 66 with a target 20 yards distant will result in a bulls eye. Alignment of the free end 70 of the first pin down from the uppermost pin with a target 30 yards distant will result in a bulls eye, and so on. This is because the flight of the arrow to the target is ballistic motion, such that for a constant initial launch velocity, the distance traveled by the arrow will be determined by the angle of launch with respect to horizontal. As such, sighting upon a target with a lower one of the pins will increase the angle of the arrow with respect to horizontal, such that the arrow will travel further.

While prior art archery sights must inherently follow these laws of physics so that lower pins correspond to greater distances, the archery sight according to the present invention exploits these laws to aide in the proper placement of the pins. Specifically, the laws of physics for ballistic motion dictate that an object launched with an initial velocity V at an angle $\theta$ with respect to the horizontal will travel a distance X, where X is defined by the equation $$X=(V^2 sin2\theta)/g$$

where g is acceleration due to gravity.

Contemporary archery bow technology will provide a substantially constant launch velocity for the arrow for a particular bow, and the acceleration due to gravity is substantially constant, such that the velocity and gravity terms may be combined into a constant, showing that for any given bow the distance the arrow will travel is proportional to the sine of twice the launch angle.

Unfortunately, the launch velocity varies between bows, and a large number of factors effect the launch angle as perceived by the archer, such as the length of the archers arm, the particular placement of the archers head just prior to launch, and other factors. While these possible variations necessitate adjustment of the present sight to proper position for a particular user and bow, the proportional relationship between the distance X and sin $2\theta$ is employed in the present invention to greatly reduce the time and effort required to correctly position the multiple pins 66. Specifically, where proper placement is known for two of the pins 66, the proportional relationship may be used to determine the proper placement for the remaining pins without the need for trial and error manual placement.

As is best shown in FIGS. 1 and 2, each of the slots 50 is substantially linear, and the spacing between the slots varies in the longitudinal direction. While this spacing varies, the spacing is proportionally constant between the pins at any position along the slots 50. This relative spacing is determined by the sin $2\theta$ function which determines the distance of arrow travel. As this is a sinusoidal function, the spacing between the various pins 66 will typically not be equal. However, for the typical range of angles employed in launching an arrow between 20 and 60 yards, the sinusoidal function is roughly linear, such that an equal spacing between the slots 50 may be an acceptable compromise in some situations.

The operation for placing the pins 66 in the proper position for a particular bow and archer will now be described. First, the archer will move the pin carriage 52 to a roughly central location on the slide member 42 and will tighten the carriage lock screws 76 to fix the carriage in position. The archer will then sight upon a target which is a known distance away, such as 20 yards, and employ the adjustment bolts 30, 34, and adjustment plate 28 to effect gross movement of the slide member 42 until the pin 66 associated with this known distance, in this example the uppermost pin 66, is roughly in the proper position to act as a sight for this target.

The user will then launch an arrow with the free end 70 of the particular pin 66 centered upon the target and will note the location at which the arrow lands. The archer will then make further adjustments using the screws 30, 34 and the adjustment plate 28 to move this first pin closer to the proper location. As in the prior art, this will continue until the slide member 42 has been moved to the proper position such that the free end 70 of this first pin may act as an accurate sight for the associated distance.

It is also noted that the orientation of the slot 50 associated with this first pin is important during this process. In particular, it is desired that the particular slot 50 extend along the archer's line of sight once the first pin has been moved to its final position. This may require some additional adjustment of the slide member 42, and may be checked by loosening the carriage lock screws 76 and moving the pin carriage to a different position upon the slide member 42 and launching another arrow at the first target. If the particular slot 50 is properly oriented the position of the pin carriage for this first pin will not alter the accuracy of the sight. The importance of this will be apparent from the discussion below.

The next step is to orient a second one of the pins 66 such that its free end may act as an accurate sight for a target at a different predetermined distance. For example, the archer may employ the lowest pin 66 with a target 60 yards away. For this adjustment, however, there is no use of the adjustment bolts 30 and 34. Due to the preset vertical alignment of the free ends 70 there should be no need for lateral adjustment of the pins, and alignment of the free end of the lowest pin should result in an arrow being launched and landing within a vertical plane containing the target. The only adjustment which should be necessary is the vertical placement of the pin.

This vertical placement is effected by movement of the pin carriage either forward or rearward to place this lowest pin in the proper position. As before, the user may repeatedly launch arrows, note the arrow position and make minor adjustments to the location of the pin carriage until the proper final position is found. At this point the carriage lock screws 76 are securely tightened such that the pin carriage will remain fixed with respect to the slide member 42, as all of the pins 66 should now automatically be located in the proper position.

Specifically, the proportional spacing between the slots 50, which corresponds to the physical laws governing ballistic flight, fixes the vertical positions of the remaining pins 66 with respect to the other two pins. It should be noted that the orientation of the first slot 50 to be along the line of sight of the user ensures that the proper vertical position of this first pin was not altered during movement of the pin carriage to determine the proper vertical position for the second pin.

To assist in this proper orientation, it is preferred that the uppermost slot 50 be angled slightly downward at an angle at least approximately equal to a standard launch angle for a 20 yard target. This will result in the slot 50 being at least approximately horizontal for the majority of archers when the gross vertical adjustment of the slide member 42 has been accomplished. It is also possible to provide the sight 10 with further gross adjustment means which will allow gross rotation about the lateral direction to assist the user in attaining proper orientation of this first slot 50.

Similarly, where the lateral positioning of the free end 70 if the pins is predetermined and fixed, it is assumed that proper placement upon the riser 18 will result in the free ends 70 being aligned in a vertical plane during use. However, material variations or other factors may result in the free ends being offset at an angle. To eliminate such a problem the sight 10 may include means for gross adjustment in rotation about the longitudinal direction to attain the proper vertical orientation of the free ends 70. Alternatively, the user may simply insert shims between the riser 18 and mounting bracket 20 to achieve the same effect.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An archery sight, comprising:

a mounting plate adapted to be fixed to an archery bow;

a slide member mounted to said mounting plate;

means for allowing lateral and longitudinal adjustment of the position of said slide member with respect to said mounting plate;

a plurality of pins mounted on said slide member for movement with respect thereto, said pins being relatively vertically spaced on said member; and means for altering said relative vertical spacing between said pins, while maintaining said spacing proportionally constant, and releasably fixing said pins against said alteration of said spacing.

2. An archery sight as in claim 1, wherein said slide member comprises a slide plate and said altering means includes a plurality of slots extending through said slide member, said slots being at least substantially linear and each having a vertical slot spacing from an adjacent one of said slots which increases in said longitudinal direction, said slot spacings being proportionally constant along said longitudinal direction, and said altering means further including a pin carriage mounted for sliding movement on said slide member, said pin carriage including a pin groove extending therethrough and oriented to extend across all of said slots throughout said sliding movement, said plurality of pins each extending through an associated one of said shots and through said pin groove.

3. An archery sight as in claim 2, wherein said means for allowing adjustment comprises an adjustment plate interposed between said mounting plate and said slide plate, said adjustment plate being mounted to said mounting plate for selectively fixable sliding movement in one of the vertical and longitudinal directions and being mounted to said slide plate for selectively fixable sliding movement in the other of the vertical and longitudinal directions.

4. An archery sight as in claim 3, wherein each of said mountings for sliding movement between said adjustment plate and said mounting plate and slide plate, comprises a dovetail groove formed in one of said adjustment plate and said mounting plate or said adjustment plate and said slide plate, and a mating tongue projecting from the other of said adjustment plate and said mounting plate to said adjustment plate and said slide member and sliding mating engagement with said associated dovetail groove.

5. An archery sight as in claim 3, wherein said slide member comprises two spaced opposed slide plates each having said slots and said pins extending through said slots of both said slide plates.

6. An archery sight as in claim 5, wherein said pin carriage includes first and second guide plates, each extending across an exterior face of said slide member containing said slots, each of said guide plates contain said pin groove extending therethrough in spaced opposed relation, and wherein said pins extend through the pin groove in each of said first and second guide plates.

7. An archery sight as in claim 6, wherein said pin carriage further includes at least one carriage lock screw threaded therethrough and adapted to abut against said slide member, thereby releasably fixing said pin carriage, and said pins, in position with respect to said slide member.

8. A method of calibrating an archery sight having a plurality of pins, each being vertically spaced from an adjacent one of said pins by a predetermined length and intended to correspond to a discrete predetermined distance and having a portion acting as a sight for targets at such predetermined distance, mounted upon an archery bow, comprising the steps of;

moving, at least one of vertically and horizontally with respect to a line of sight for said bow, said pins as a unit to accurately position a first of said pins such that said portion of said first of said pins acts as a sight at an associated one of said predetermined distances;

moving the remainder of said pins proportionate distances vertically, thereby maintaining a proportionate vertical spacing among said pins, to accurately position a second of said pins such that said portion of said second of said pins acts as a sight at an associated one of said predetermined distances, and thereby accurately positioning all further remaining ones of said pins such that said portions of said further remaining pins acts as sights at associated ones of said predetermined distances.

* * * * *